US005801669A

United States Patent [19]

Hall

[11] Patent Number: 5,801,669

[45] Date of Patent: Sep. 1, 1998

[54] HIGH PERMEABILITY TAPPED TRANSMISSION LINE

[75] Inventor: Garrett W. Hall, Boise, Id.

[73] Assignee: Micron Display Technology, Inc., Boise, Id.

[21] Appl. No.: 752,610

[22] Filed: Nov. 19, 1996

[51] Int. Cl.[6] ..... G09G 3/22

[52] U.S. Cl. ..... 345/74; 345/204

[58] Field of Search ..... 345/74, 59, 75, 345/98, 99, 204, 208, 209, 211; 315/169.1, 169.2

[56] References Cited

U.S. PATENT DOCUMENTS

| | | | |
|---|---|---|---|
| 3,581,250 | 5/1971 | Eichert | 333/6 |
| 3,670,270 | 6/1972 | Storey, II | 333/30 |
| 3,778,643 | 12/1973 | Jaffe | 307/293 |
| 4,145,685 | 3/1979 | Farina | 340/782 |
| 4,675,627 | 6/1987 | Johnston | 333/161 |
| 5,519,414 | 5/1996 | Gold et al. | 345/208 |
| 5,608,331 | 3/1997 | Newberg et al. | 324/613 |

OTHER PUBLICATIONS

Allen, Mark G., "Integrated Inductors for Low Cost Electronic Packages," *International Electron Device Meeting Technical Digest*: 95–137 to 95–141, Dec. 1995.

Miller, Harry, "Liquid Crystal Displays: An Examination of Active Matix Technologies and Components," *Sharp LCD Application Note*: 2–10 to 2–12, undated.

*Primary Examiner*—Regina Liang

*Attorney, Agent, or Firm*—Seed and Berry LLP

[57] ABSTRACT

A transmission line includes a high permeability conductor. The high permeability conductor increases the inductance-per-length of the transmission line to reduce the propagation velocity along the line. The high permeability conductor supplements a high dielectric constant insulator and high permeability core that increase the capacitance-per-length and inductance-per-length, respectively. In one embodiment, the transmission line is a microstrip line that is used in a matrix addressable display. In another embodiment, the transmission line is a coaxial line where the central conductor includes a center layer of nonmagnetic material and an outer layer of high permeability material. The high permeability conductor can be formed from a single layer of high permeability material or may be formed from a central layer of high conductivity material coated with an outer layer of a high permeability conductor.

9 Claims, 2 Drawing Sheets

HIGH PERMEABILITY TAPPED TRANSMISSION LINE

STATEMENT AS TO GOVERNMENT RIGHTS

This invention was made with government support under Contract No. DABT 63-93-C-0025 awarded by Advanced Research Projects Agency ("ARPA"). The government has certain rights in this invention.

TECHNICAL FIELD

The present invention relates to transmission lines, and more particularly, to transmission lines having selected propagation velocities.

BACKGROUND OF THE INVENTION

Electrical transmission lines are used in a variety of applications, such as carrying communication signals between spaced-apart locations. In some applications, the transmission lines are used as delay lines to induce delay in electrical signals. For example, U.S. patent application Ser. No. 08/019,774 of Gold et al., and assigned to OWL Display, Inc., discloses a tapped microwave transmission line using coincident pulses to control a matrix addressable display.

Often, the delay line must be very long to produce adequate delays. For example, the propagation-delay time per unit length for a microstrip line in a non-magnetic medium is $T_d=1.016\sqrt{\epsilon_r}$ ns/ft where $\epsilon_r$ is a relative dielectric constant of the substrate, as described in Liao, "Microwave Devices and Circuits," 2d Ed., Prentice Hall, Inc., 1985. For a relative dielectric constant $\epsilon_r$ of 2.0, the propagation-delay time per unit length is 1.437 ns/ft. Thus, for a 100 ns delay, the line would be approximately 69.6 ft. Unfortunately, such long lengths of transmission line are extremely large and lossy making such lines undesirably for many applications.

To address such drawbacks, much work has been directed toward decreasing the propagation velocity $V_P$ of signals in transmission lines because the propagation delay $T_d$ of a signal in a transmission line is inversely proportional to the propagation velocity $V_P$. The propagation velocity $V_P$ for a transmission line is inversely proportional to the square-root of the effective dielectric constant $\epsilon_e$, times the effective permeability $\mu_e$. Thus, the propagation velocity is $$V_p=\frac{1}{\sqrt{\mu_e\epsilon_e}}$$

and the propagation-delay time per unit length $T_d$ is $T_d=\sqrt{\mu_e\epsilon_e}$.

The effective permeability $\mu_e$ and the effective dielectric constant $\epsilon_e$ are determined by the transmission line geometry, the relative permeabilities $\mu_r$ of the materials, and the relative dielectric constants $\epsilon_r$ of the materials. The propagation velocity $V_P$ thus increases as a function of the relative dielectric constants $\epsilon_r$ and the relative permeabilities $\mu_r$ of the materials.

Previous attempts to reduce propagation velocities $V_P$ in transmission lines have focused primarily upon the dielectric medium because increases in the relative dielectric constant $\epsilon_r$ of the dielectric medium increase the effective dielectric constant $\epsilon_e$ and thereby decrease the propagation velocity $V_P$ along the transmission line. For example, for microstrip lines, a variety of substrate materials having extremely large relative dielectric constants $\epsilon_r$ have been suggested. Such increases are limited by the availability and cost of high relative dielectric constant materials.

To further reduce propagation velocity, the relative permeability $\mu_r$ of the substrate material and/or the surrounding regions can also be increased. Such increases in relative permeability $\mu_r$ of the substrate or surrounding regions increases the effective permeability $\mu_e$ of the transmission line, thereby decreasing propagation velocity $V_P$. However, such increases are limited by relative permeabilities of available materials, physical constraints of the transmission line structure and losses of the available materials.

Such constraints can be particularly problematic in small transmission lines, such as microstrip lines in matrix addressable displays. In such displays, spacing between adjacent columns is very small to allow relatively high resolution. Consequently, if the microstrip lines extend between successive columns of the display, the time delay between arrival of pulses of successive columns is very small. To increase the timing separation between adjacent columns, the microstrip line can be formed in a serpentine pattern. However, this approach is limited by the physical constraints of the display and the losses of the serpentine microstrip line. Consequently, additional reductions in the propagation velocity $V_P$ remain desirable.

SUMMARY OF THE INVENTION

A transmission line incorporates a high permeability material as a conductor. In the preferred embodiment of the invention, the high permeability conductor cooperates with a high dielectric constant insulator and a high permeability core material to reduce the propagation velocity $V_P$ along the transmission line.

In one aspect of the invention, the transmission line is a serpentine microstrip line in a matrix addressable display. Alternating turns of the serpentine microstrip are tapped to drive successive columns of the display. The microstrip line is driven at opposite ends by a pulsed image signal and a control pulse, respectively. The control pulse and image pulses are timed to constructively interfere at successive ones of the taps to produce a tap voltage that is the sum of the image pulse voltage and the control pulse voltage. The constructively interfered voltage breaks down a reverse-biased diode in a discharge circuit to provide an image signal to the column line.

The arrival time of the control pulse at each successive tap is determined by the microstrip's length and the propagation velocity $V_P$. The propagation velocity $V_P$ is affected by the relative dielectric constant $\mu_r$ of the microstrip substrate, the relative permeability $\mu_{rint}$ of the conductor, and the relative permeability $\mu_{rext}$ of the core material partially surrounding the conductor.

In one embodiment, the transmission line conductor includes two layers. A first, central layer is formed from a conventional, highly conductive material to provide a low resistivity portion of the conductor. The outer layer is formed from a high permeability conductive material to increase the effective permeability of the conductor. The low permeability of the central layer reduces the effective permeability of the conductor; however, this effect is less noticeable at high frequencies. At high frequencies, the current density of signals carried by the conductor increases near the surface of the conductor, as can be predicted from standard skin depth calculations. Therefore, the thickness of the outer layer of high permeability conductor can be selected based upon the expected operating frequency of the transmission line and the resulting skin depth.

DETAILED DESCRIPTION OF THE INVENTION

Figure 1:
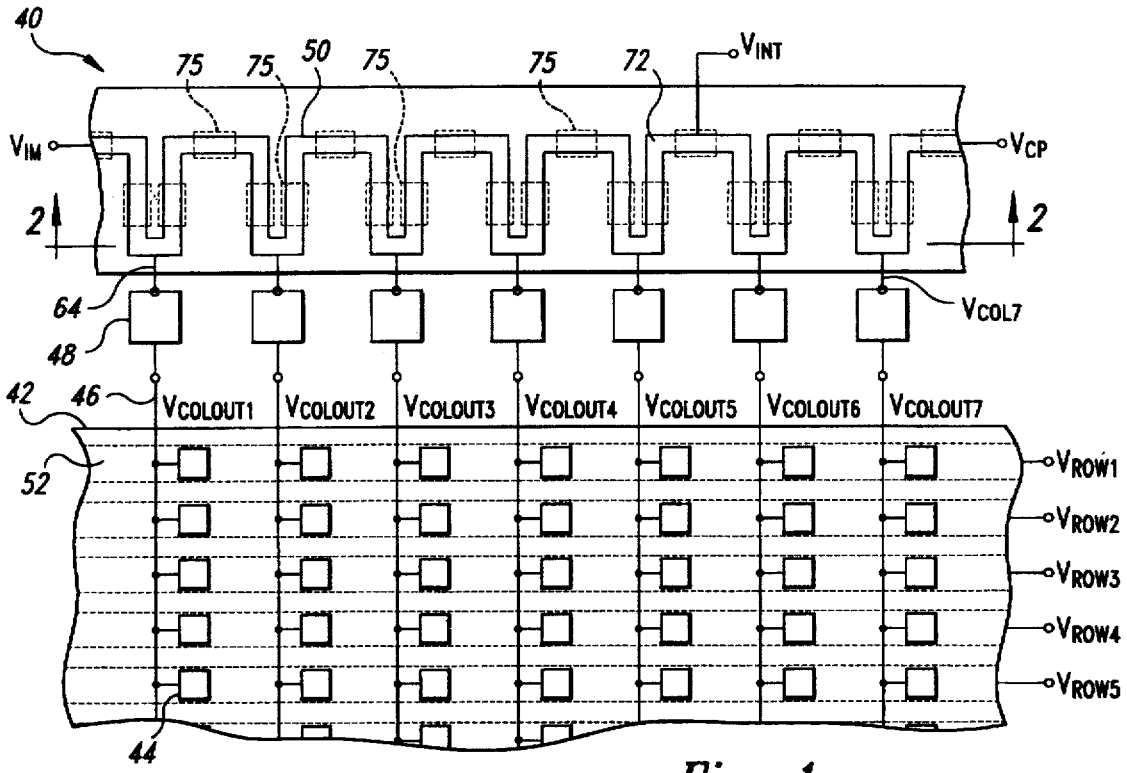
FIG. 1 is a top plan view of a portion of a matrix addressable display showing a microstrip delay line having several taps coupled to respective columns of an array.

As shown in FIG. 1, a field emission display 40 includes an emitter substrate 42 including several emitter sets 44 arranged in rows and columns. The emitter sets 44 in each column are coupled to common column lines 46 driven by respective driving circuits 48. The driving circuits 48 are driven in turn by a microstrip transmission line 50.

Several parallel conductive extraction grids 52 cover the emitter substrate 42, where each extraction grid 52 is aligned to a row of emitter sets 44 and thus intersects every column. As is known, the emitter set 44 can be selectively activated by producing a voltage differential between a selected one of the extraction grids 52 and one of the emitter sets 44. To create the voltage differential, one of the extraction grids 52 is biased to a voltage of about 30–120V and one of the column lines 46 is driven to a low voltage, such as ground, by the driving circuit 48 to produce a voltage differential at the intersection of the extraction grid 52 and the column. The voltage differential between the extraction grid 52 and the emitter set 44 produces an electric field extending from the extraction grid 52 corresponding to the emitter set 44 and having sufficient intensity to cause the emitter set 44 to emit electrons. The emitted electrons strike a cathodoluminescent layer of a display screen (not shown) causing the cathodoluminescent layer to emit light that is visible to an observer. The intensity of the emitted light is determined in part by the rate at which electrons strike the cathodoluminescent layer. The rate at which electrons are emitted is determined in turn by the voltage differential between the extraction grid 52 and the emitter set 44. The rate at which electrons are emitted by the emitter set 44 can therefore be determined by the voltage of the column line 46, because the extraction grid 52 is biased to a fixed voltage. The driving circuit 48 can therefore control the intensity of light emitted from the emitter set 44 by controlling the voltage of the column line 46.

Figure 2:
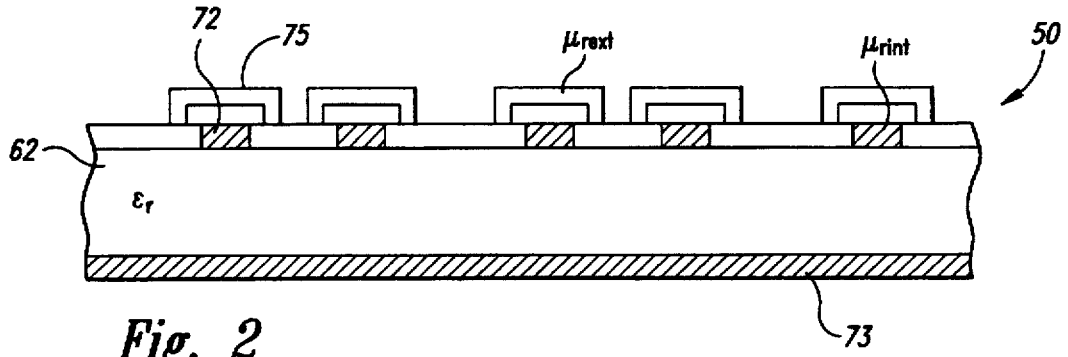
FIG. 2 is a side cross-sectional view of the microstrip transmission line of FIG. 1 along a line 2—2.
Figure 4A:
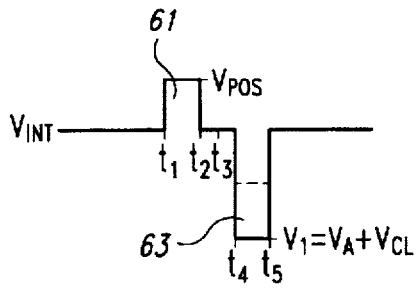
FIG. 4A is a tiring diagram showing a composite signal formed from constructive interference of an image signal and control pulse.

The transmission line 50 supplies signal pulses as shown in FIG. 4A to the driving circuits 48. As shown in FIGS. 1 and 2, the transmission line 50 is a microstrip line formed from an upper conductor 72 and base conductor 73 (FIG. 2) on a substrate 62 having a high relative dielectric constant $\epsilon_r$. To provide adequate transmission line length, the upper conductor 72 is formed in a serpentine pattern. While the transmission line 50 is preferably a microstrip line, other transmission line structures, such as strip lines or coaxial lines, may also be within the scope of the invention.

The transmission line 50 is tapped by several equally spaced taps 64 at alternating turns of the serpentine pattern. Each tap 64 provides a column signal $V_{COL}$ to a respective driving circuit 48. The column signal $V_{COL}$ at each tap 64 is a composite signal including a positive pulse 61 and a negative pulse 63, as shown in FIG. 4A.

Figure 4B:
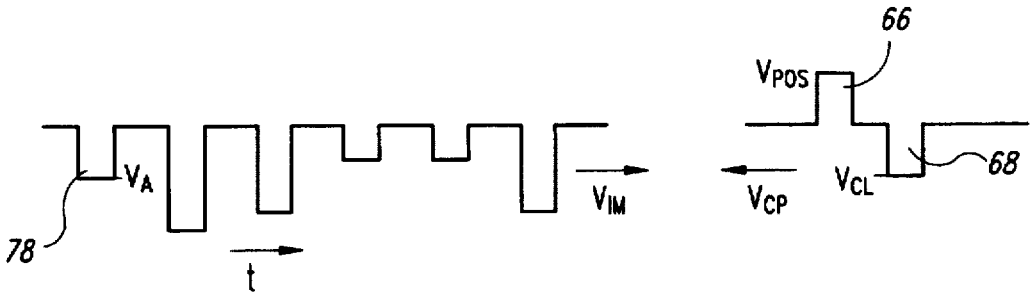
FIG. 4B is a signal timing diagram showing an image signal and a control pulse traveling in opposite directions on the transmission line of FIG. 1 to form the composite signal of FIG. 4A.

Generation of the composite signal of FIG. 4A is best described with reference to FIGS. 1 and 4B. The transmission line 50 receives an image signal $V_{IM}$ at its left end and a control pulse $V_{CP}$ at its right end. As seen in FIG. 4B, the image signal $V_{IM}$ is a pulse train having equally spaced, variable amplitude, negative-going pulses. As will be explained below, the amplitude of each pulse of the image signal $V_{IM}$ represents the brightness of a pixel in a corresponding column. The control pulse $V_{CP}$ is input to the right end of the transmission line 50 and includes a positive portion 66 followed by a negative portion 68. The negative portion 68 of the control pulse $V_{CP}$ is delayed relative to the positive portion 66 to ease timing control constraints along the transmission line 50 and to allow time for extraction grids 52 (FIG. 1) to go high after clearing, as will be described below.

As the control pulse $V_{CP}$ travels from right to left along the transmission line 50, the control pulse $V_{CP}$ intercepts each successive pulse of the image signal $V_{IM}$. The relative timing of the image signal $V_{IM}$ and the control pulse $V_{CP}$ is tightly controlled such that the positive portion 66 arrives alone at each tap 64 and the negative portion 68 and each successive pulse of the image signal $V_{IM}$ arrive simultaneously at each successive tap 64. Each control pulse $V_{CP}$ constructively interferes with the pulse of the image signal $V_{IM}$ to produce a respective composite signal at each of the taps 64.

The composite signal for the leftmost tap 64 is shown in FIG. 4A. Before the composite signal arrives, the tap 64 is biased at an intermediate voltage $V_{INT}$, by applying a DC voltage to the upper conductor 72. Then, the positive portion 66 of the control pulse arrives at the leftmost tap 64. The positive portion 66 quickly raises the tap voltage to the pulse voltage $V_{POS}$ at time $t_1$. When the positive portion 66 passes the tap 64, the tap voltage drops to the intermediate voltage $V_{INT}$ at time $t_2$.

Later, the negative portion 68 and the last pulse 78 of the image signal $V_{IM}$ arrive at the tap 64 at time $t_4$. The last pulse 78 and the negative portion 68 constructively interfere to produce a tap voltage $V_1$ having a negative-going magnitude that is the sum of the voltages $V_A$, $V_{CL}$ of the last pulse 78 and the negative portion 68. When the last pulse 78 and the negative portion 68 leave the tap 64, the tap voltage returns to the intermediate voltage $V_{INT}$.

One skilled in the art will recognize that each of the taps 64 receives a similar composite signal if each successive pulse of the image signal $V_{IM}$ is timed to intercept the control pulse $V_{CP}$ at each successive tap 64. For example, the second-to-last pulse of the image signal $V_{IM}$ arrives at the second tap 64 from the left simultaneously with the negative portion 68 of the control pulse $V_{CP}$. Similarly, the first pulse of the image signal $V_{IM}$ arrives at the rightmost tap 64 simultaneously with the negative portion 68 of the control pulse $V_{CP}$. The constructively interfered image signal pulses and the control pulse $V_{CP}$ thus provide the composite signals to each of the driving circuits 48.

The separation between pulses at subsequent taps 64 is determined by the distance (along the transmission line 50) between successive taps 64 and the propagation velocity $V_P$ of pulses along the transmission line 50. To slow propagation of the control pulse $V_{CP}$ and the image signal $V_{IM}$ along the transmission line 50, the relative dielectric constant $\epsilon_r$ of the substrate 62 is very high. The slowed propagation of the signals $V_{IM}$, $V_{CP}$ facilitates timing arrivals of pulses at successive taps 64 by increasing the time between arrivals of successive pulses of the image signal $V_{IM}$ at each tap 64 without requiring an excessively long transmission line 50.

To further reduce the propagation velocity $V_P$, high permeability cores 75 are bonded to the substrate 62 to increase the relative permeability $\mu_{rext}$ of the regions surrounding the upper conductor 72, as best seen in FIG. 2. The relative permeability $\mu_{rext}$ of the regions surrounding the upper conductor 72 will be referred to herein as the external relative permeability $\mu_{rext}$. The increased external relative permeability $\mu_{rext}$ increases the overall effective permeability $\mu_e$ of the transmission line 50, because a portion of the B-field of a signal on the transmission line 50 travels through the region surrounding the upper conductor 72. As described above, the propagation velocity $V_P$ of the transmission line 50 is inversely proportional to the square root of the effective permeability $\mu_e$. Therefore, increasing the external relative permeability $\mu_{rext}$ decreases the propagation velocity $V_P$.

In addition to increasing the relative dielectric constant $\mu_r$ and the external permeability $\mu_{rext}$, the inductance-per-length is further increased by forming the upper conductor 72 from a conductive material having a high relative permeability $\mu_r$, typically greater than 10. For example, conventional iron typically has a permeability greater than 1,000, pure iron may have a relative permeability $\mu_r$ of about 280,000, permalloy (78.5% Ni, 21.5% Fe) have been produced with relative permeabilities of about 70,000 and supermalloys (e.g., 79% Ni, 15% Fe, 0.5% Mo, 0.5% Mn) have been shown to have relative permeabilities on the order of 1,000,000. The high relative permeability $\mu_r$ of such materials increases the internal relative permeability $\mu_{rint}$, i.e., the permeability within the upper conductor 72. The high internal relative permeability $\mu_{rint}$ of the upper conductor 72 in turn increases the overall effective relative permeability $\mu_{reff}$ (and thus the effective permeability $\mu_e$) of the transmission line 50, because the effective permeability $\mu_{reff}$ increases when either the internal permeability $\mu_{rint}$ or the external permeability $\mu_{rext}$ is increased. Consequently, increasing the relative permeability $\mu_r$ of the upper conductor 72 decreases propagation velocity $V_P$ through the transmission line 50.

Figure 3:
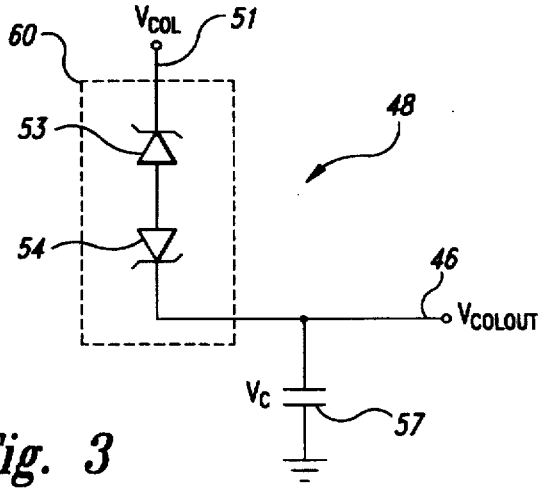
FIG. 3 is a schematic of a charging and clearing circuit in the matrix addressable display of FIG. 1.

FIG. 3 shows one suitable driving circuit 48 used in the field emission display 40 of FIG. 1. The driver circuit 48 includes a discharge circuit 60 coupled between the column input 51 and the column line 46. The driving circuit 48 also includes a storage capacitor 57 coupled between the column line 46 and ground. The discharge circuit 60 is formed from a pair of opposed diodes 53, 54 coupled between the input line 51 and the column line 46. The diodes 53, 54 are Zener diodes having well-defined breakdown voltages $V_{BU}$, $V_{BL}$, well-defined forward bias voltages $V_{FB}$, and rapid recovery times.

Operation of the display 40 will now be explained with reference to the signal of FIG. 4A. First, at a time $t_1$, the positive portion 61 of the first composite signal pulse having the voltage $V_{POS}$ arrives at the upper diode 53. The voltage $V_{POS}$ is greater than the breakdown voltage $V_{BU}$ of the upper diode 53 plus the forward bias voltage $V_{FB}$ of the lower diode 54, so that the positive portion 66 breaks down the upper diode 53. In response, the capacitor 57 quickly charges to a cleared voltage $V_{CL}$ equal to the voltage of the positive-going portion less the breakdown voltage $V_{BU}$ of the upper diode 53 and the forward bias voltage $V_{FB}$ of the lower diode 54. The cleared voltage $V_{CL}$ is greater than the emission voltage $V_{EM}$ of the emitter sets 44. Therefore, the emitter sets 44 coupled to the capacitor 57 will not emit electrons.

At time $t_2$, the composite signal returns to the intermediate voltage $V_{INT}$ which is between the magnitude $V_P$ of the positive-going portion and the capacitor voltage $V_C$. The voltage difference between the column voltage $V_{COL}$ and the capacitor voltage $V_C$ is less than the breakdown voltages $V_{BU}$, $V_{BL}$ of the diode 53, 54. Thus, after the upper diode 53 recovers, current does not flow into the capacitor 57, because the reverse-biased upper diode 53 forms an open circuit.

Next, at time $t_3$, the grid voltage $V_{ROW1}$ on a first of the extraction grids 52 (FIG. 1) goes high to approximately 30–120V. The emitter sets 44 at this time are at the capacitor voltage $V_C$, because the emitter sets 44 are electrically connected to the capacitor 57. Because the capacitor voltage $V_C$ is relatively high, the emitter set 44 at the intersection of the uppermost extraction grid 52 and the leftmost column is close to the grid voltage $V_{ROW1}$ and does not emit electrons.

Next, the negative portion 63 of the composite signal arrives at a time $t_4$ with a voltage $V_1$, as referenced below the emitter voltage $V_{EM}$. In response to the negative portion 63, the lower diode 54 breaks down and conducts current, because the difference between the capacitor voltage $V_C$ and the voltage $V_1$ is greater than the breakdown voltage $V_{BL}$ of the lower diode 54 plus the forward bias voltage $V_{FB}$ of the upper diode 53. The capacitor 57 discharges quickly until the voltage difference between the capacitor voltage $V_C$ and the voltage $V_1$ equals the breakdown voltage $V_{BL}$ of the lower diode 54 plus the forward bias voltage $V_{FB}$ of the upper diode 53.

The composite pulse then returns to the intermediate voltage $V_{INT}$ at time $t_5$ and the diodes 53, 54 once again form open circuits, trapping the voltage $V_1$ minus the upper diode breakdown voltage $V_{BU}$ and the lower diode forward bias voltage $V_{FB}$ on the capacitor 57. The voltages of the emitter sets 44 equal the capacitor voltage $V_C$ and the voltage difference between the first extraction grid 52 and the first emitter set 44 causes the first emitter set 44 to emit electrons. The remaining emitter sets 44 on the column line 46 are unaffected, because only the first extraction grid 52 is at a high voltage. As described above, the emitted electrons cause light emission above the emitter set 44.

As the first emitter set 44 emits electrons, the emitted electrons are replaced by electrons drawn from the capacitor 57. The capacitor voltage $V_C$ rises slightly as the electrons flow from the capacitor 57 to the first emitter set. However, the capacitor 57 is sufficiently large and the total current through the emitter set 44 is sufficiently small that the capacitor voltage $V_C$ remains at substantially constant level over the entire time that the first extraction grid 52 is high.

The time during which the capacitor 57 provides electrons to the emitter set 44 is substantially longer than the direction of the negative portion 63 of the composite signal. For example, for a typical refresh interval of about 35 μs, each capacitor 57 will be recharged in an interval of about 0.02 μs for a 640 column color display or 0.055 μs for a monochrome display. Consequently, the width of the negative portion 63 of the composite signal can be very short relative to the refresh time of the display.

Figure 5:
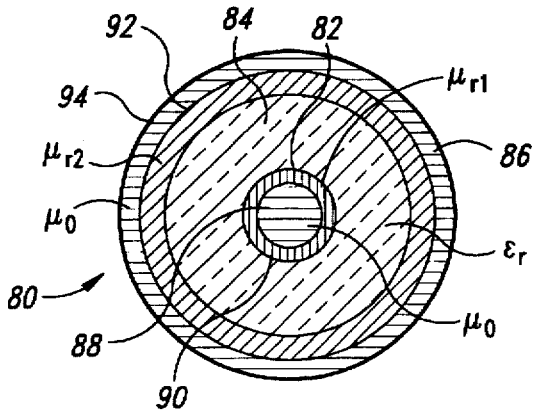
FIG. 5 is a cross-sectional view of a coaxial transmission line where the central conductor includes a central layer of high conductivity material and an outer layer of high permeability material.

According to aspect of the invention, FIG. 5 shows a coaxial transmission line 80. The coaxial transmission line 80 is formed from a center conductor 82 surrounded by a dielectric 84 that is, in turn, surrounded by an outer conductor 86. The dielectric 84 is a conventional dielectric having a high relative dielectric constant $\epsilon_r$. The center conductor 82 and outer conductor 86 each include radially inner and radially outer layers 88, 90 and 92, 94, respectively. The radially inner layer 88 of the center conductor 82 is a highly conductive material having a relative permeability $\mu_r$ of approximately 1, i.e., a permeability equal to the permeability of free space $\mu_0$. The radially outer layer 90 of the center conductor 82 is a high permeability conductor having a relative permeability $\mu_{r1}$ greater than 1. Similarly, the radially inner layer 92 of the outer conductor is a high permeability conductive material having a relative permeability $\mu_{r2}$ greater than 1. The radially outer layer 94 of the outer conductor 86 is a highly conductive material having a relative permeability substantially equal to 1.

The use of two layers 88, 90 and 92, 94 for the conductors 82, 86 allows the conductors to be made more cheaply and with higher conductivity than conductors formed solely from high permeability conductive material. Of course, the overall permeability of the center conductor 82 will be lower than the relative permeability $\mu_{r1}$ of the radially outer layer 90, because the overall permeability of the center conductor is partly a function of the permeability $\mu_0$ of the radially inner layer 88. Similarly, the overall relative permeability of the outer conductor 86 will be lower than the relative permeability $\mu_{r2}$ of its radially inner layer 92, because the effective permeability of the outer conductor 86 is, in part, a function of the relative permeability $\mu_0$ of the radially outer layer 94. Thus, the inductance-per-length of the coaxial transmission line 80 will be lower than a transmission line having similar dimensions where the center and outer conductors 82, 86 are made completely of high permeability conductors. However, it is well known that the current density of electric signals in a transmission line is determined using skin depth calculations. For a coaxial transmission line, such as the transmission line 80, the current density will be highest near the outer surface of the center conductor 80, i.e., in the radially outer layer 90. As the frequency of signals carried by the transmission line 80 increase, current density is increasingly confined to the radially outer layer 90. Consequently, as frequency increases, the reduction in effective permeability due to the low permeability inner layer 88 will diminish. Thus, as frequency increases, the effective permeability of the center conductor 82 approaches the relative permeability $\mu_{r2}$ of the high permeability outer layer 90. The effect on the propagation velocity $V_P$ will approximate the propagation velocity of a transmission line having a center conductor and outer conductor formed completely of high permeability conductive material. Alternatively, if a particular application makes it desirable to reduce the effect of high permeability conductor at low frequencies, the materials of the coaxial transmission line 80 of FIG. 5 can be reversed so that the outer layer 90 of the center conductor 82 has a relative permeability of 1 and the inner layer 88 has a high relative permeability. Thus, as frequency increases, the effective permeability approaches the permeability of free space $\mu_0$.

One skilled in the art will recognize several variations on the timing of the signals $V_{CP}$, through $V_{IM}$ that are within the scope of the invention. For example, one skilled in the art will recognize several variations in the timing, magnitude, and approach to constructively interfered pulses along tapped transmission lines. Also, the driving circuit 48 can be realized with alternative circuit structures, such as the field effect transistor-based structure described in U.S. patent application Ser. No. 08/746,965 entitled High Impedance Transmission Line Tap Circuit of Zimlich and Hall which is commonly assigned with the present application and is incorporated herein by reference. Additionally, a variety of other transmission line structures can be realized according to the invention. For example, the two layer, dual-permeability conductor structure described with respect to FIG. 5 can be adapted to the upper conductor 72 and base conductor of the microstrip transmission line 50 of FIGS. 1 and 2, a strip line, a hollow transmission line or to various other transmission line structures.

While the present invention has been described by way of an exemplary embodiment, various modifications to the embodiment described herein can be made without departing from the scope of the invention. Accordingly, the present invention is not limited except as by the appended claims.

I claim:

1. A matrix addressable display, comprising:

a display panel including a plurality of signal lines;

an input signal source producing a plurality of input signals, each input signal being produced at a respective starting time;

a delay line coupled to receive the input signals from the input signal source at a first input terminal, the delay line including a first conductor coupled to respective ones of the signal lines at respective spaced-apart locations along the delay line, each of the spaced-apart locations corresponding to a respective desired delay time between the starting time of the respective input signal and a respective arrival time of the respective input signal at the spaced-apart locations, the first conductor having a first conductive portion having a relative permeability greater than 1, the relative permeability of the first conductive portion being selected such that actual delay times between arrivals of the input signals at respective signal lines substantially equal the respective desired delay times; and a control pulse source coupled to the delay line at a second input terminal on the delay line that is spaced-apart from the first input terminal, the permeability of the first conductive portion being selected such that control pulses from the control pulse source and input signals from the input signal source constructively interfere at selected ones of the spaced apart locations.

2. The matrix addressable display of claim 1, further including a second conductor extending parallel to the first conductor and spaced-apart from the first conductor by a dielectric, the second conductor having a relative permeability substantially equal to the relative permeability of the first conductive portion.

3. The matrix addressable display of claim 2 wherein the first conductor, the second conductor and the dielectric are shaped to form a coaxial transmission line.

4. The matrix addressable display of claim 2 wherein the first conductor has a second conductive portion including a second material that is conductive and has a relative permeability substantially equal to 1.

5. The matrix addressable display of claim 4 wherein the first conductive portion is positioned between the second portion and the second conductor.

6. The matrix addressable display of claim 1 wherein the permeability of the first conductive portion is greater than 1,000.

7. The matrix addressable display of claim 1 wherein the delay line is a microstrip line including a dielectric substrate and wherein the first conductor is a patterned strip carried by the dielectric substrate.

8. The matrix addressable display of claim 1 wherein the delay line is patterned in a serpentine pattern.

9. The display of claim 1 wherein the input signals include a principal component at a first frequency and the permeability of the first conductive portion is selected such that the actual delay time is substantially equal to the desired delay time at the first frequency.

* * * * *